US011459194B2

(12) United States Patent
Morita

(10) Patent No.: US 11,459,194 B2
(45) Date of Patent: Oct. 4, 2022

(54) SHEET LOADING DEVICE AND IMAGE FORMING APPARATUS

(71) Applicant: KYOCERA Document Solutions Inc., Osaka (JP)

(72) Inventor: Takuro Morita, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 120 days.

(21) Appl. No.: 17/034,690

(22) Filed: Sep. 28, 2020

(65) Prior Publication Data

US 2021/0094773 A1 Apr. 1, 2021

(30) Foreign Application Priority Data

Sep. 30, 2019 (JP) ..... JP2019-179173

(51) Int. Cl.
*B65H 1/04* (2006.01)
*B65H 7/02* (2006.01)

(52) U.S. Cl.
CPC ..... *B65H 1/04* (2013.01); *B65H 7/02* (2013.01); *B65H 2407/21* (2013.01); *B65H 2511/10* (2013.01); *B65H 2511/11* (2013.01); *B65H 2553/61* (2013.01)

(58) Field of Classification Search
CPC ... B65H 1/04; B65H 7/02; B65H 7/04; B65H 2407/21; B65H 2511/11; B65H 2553/60; B65H 2553/61; B65H 2553/612
See application file for complete search history.

(56) References Cited

U.S. PATENT DOCUMENTS

2004/0056413 A1* 3/2004 Shirakura ..... B65H 1/04 271/145
2015/0336756 A1* 11/2015 Lee ..... H04N 1/0066 271/240

FOREIGN PATENT DOCUMENTS

JP H09-188443 A 7/1997

* cited by examiner

*Primary Examiner* — Prasad V Gokhale
(74) *Attorney, Agent, or Firm* — Studebaker & Brackett PC

(57) ABSTRACT

A sheet stacking device includes a tray having a sheet loading surface on which a sheet fed in a predetermined feeding direction is loaded. The tray includes a main tray, an extension tray and a first detection part. The first detection part includes a first sensor, a first detected piece and a first contact piece. The first detected piece is turnably supported by the extension tray and switches the first sensor between an ON state and an OFF state. The first contact piece is turnably supported by the first detected piece, and protrudes above and retracts below the sheet loading surface.

9 Claims, 7 Drawing Sheets

FIG. 7

| | SMALL SIZE | INTERMEDIATE SIZE | LARGE SIZE | EXTENSION TRAY IN STORAGE POSITION |
|---|---|---|---|---|
| SHEET DETECTION PART 57 | ON | ON | ON | OFF |
| FIRST SENSOR 41 | OFF | ON | ON | OFF |
| SECOND SENSOR 39 | OFF | OFF | ON | ON |

SHEET LOADING DEVICE AND IMAGE FORMING APPARATUS

INCORPORATION BY REFERENCE

This application is based on and claims the benefit of priority from Japanese Patent applications No. 2019-179173 filed on Sep. 30, 2019, which are incorporated by reference in its entirety.

TECHNICAL FIELD

The present disclosure relates to a sheet loading device having a tray on which a sheet to be fed in a predetermined direction is loaded, and an image forming apparatus provided with the sheet loading device.

BACKGROUND

A sheet loading device provided in an image forming apparatus includes a tray (for example, a manual bypass tray) on which a sheet to be fed in a predetermined direction is loaded. The tray is typically provided with a detection structure which detects a size of the sheet to be loaded. The detection structure is configured to detect a size of the sheet at three stages including a small size (for example, a A5 size and a Statement size), an intermediate size (for example, a A4 size and a Letter size) and a large size (for example, a Folio size and Legal size) by using two detection sensors, for example.

On the other hand, for the intermediate size sheet and the large size sheet, the tray is sometimes provided with an extension tray extendable in the upstream side in the feeding direction. Alternatively, the manual bypass tray is sometimes provided with a drawing detection sensor and a sheet loading detection sensor. The drawing detection sensor detects that a loading support plate (the extension tray) is drawn out, and the sheet loading detection sensor detects that a large size sheet is loaded on the loading support plate. When the drawing sensor is switched into an ON state and the sheet loading detection sensor is switched into an ON state, it is determined that a large size sheet is loaded.

However, in the above described manual bypass tray, in order to distinguish a large size sheet from an intermediate size sheet, another detection sensor is required. As the number of the sensor is increased, the cost is increased, and the structure and control of the device becomes complicated.

SUMMARY OF THE INVENTION

In accordance with one aspect of the present disclosure, a sheet loading device includes a tray having a sheet loading surface on which a sheet fed in a predetermined feeding direction is loaded. The tray includes a main tray, an extension tray and a first detection part. The main tray has a storage part on an upstream side in the feeding direction. The extension tray is displaceable between a storage position where the extension tray is stored in the storage part and an extension position where the extension tray extends from the storage part to the upstream side in the feeding direction. The first detection part is provided in the extension tray and detects a first size sheet. The first detection part includes a first sensor; a first detected piece turnably supported by the extension tray to switch the first sensor between an ON state and an OFF state, and a first contact piece turnably supported by the first detected piece, and protruding above and retracting below the sheet loading surface. In a state where the extension tray is arranged in the extension position, when the first size sheet is not loaded on the extension tray, the first contact piece is turned so as to protrude above the sheet loading surface and the first detected piece is turned so as to switch the first sensor from the ON state into the OFF state, and when the first size sheet is loaded on the extension tray, the first contact piece is turned so as to be retracted below the sheet loading surface by coming into contact with the first size sheet, and the first detected piece is turned so as to switch the first sensor from the OFF state into the ON state. In a state where the extension tray is arranged in the storage position, the first contact piece comes into contact with an upper wall of the storage part and is turned so as to retract below the sheet loading surface, and the first detected piece interferes with a restriction part provided in the storage part and is inhibited from being turned so as to switch the first sensor from the OFF state into the ON state.

The above and other objects, features, and advantages of the present disclosure will become more apparent from the following description when taken in conjunction with the accompanying drawings in which a preferred embodiment of the present disclosure is shown by way of illustrative example.

BRIEF DESCRIPTION OF THE DRAWINGS

FIG. 7 is a table showing a determination result in the sheet loading device according to one embodiment of the present disclosure.

DETAILED DESCRIPTION

Hereinafter, with reference to the attached drawings, an image forming apparatus and a sheet loading device according to an embodiment of the present disclosure will be described.

Figure 1:
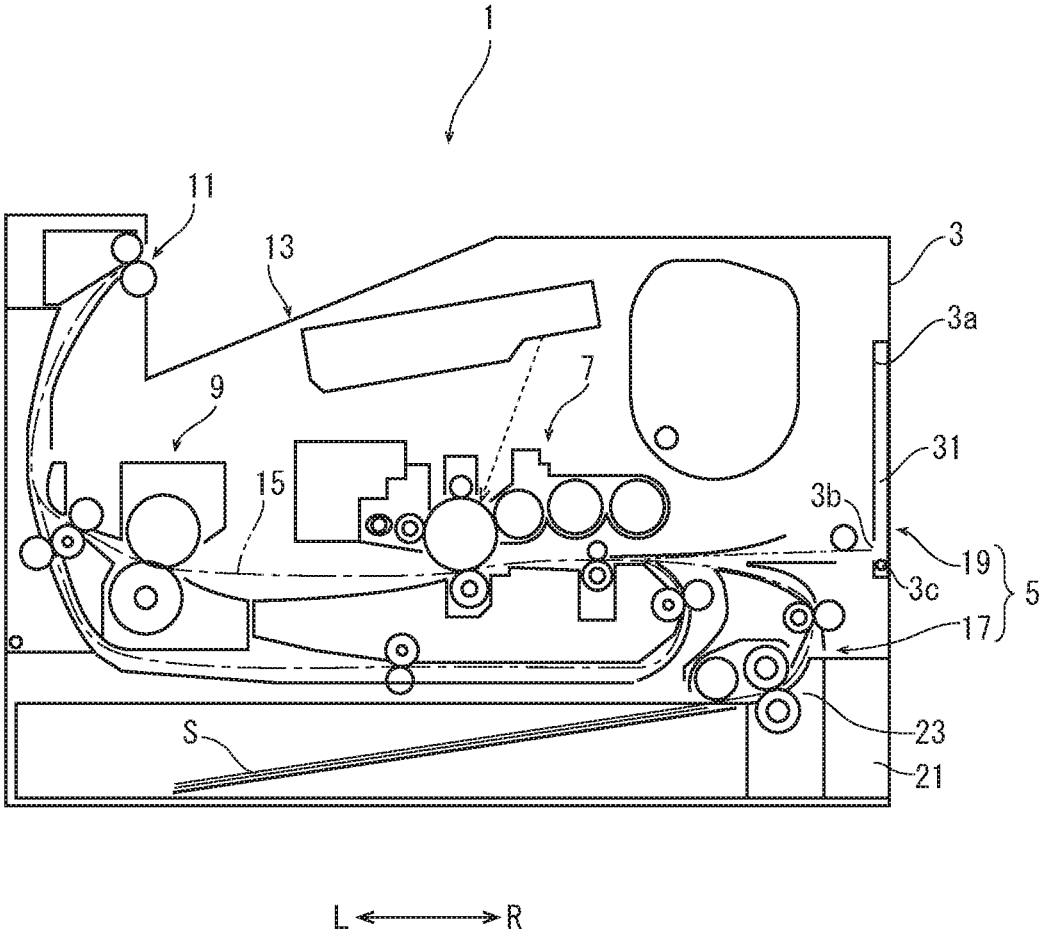
FIG. 1 is a front view schematically showing an inner structure of an image forming apparatus according to one embodiment of the present disclosure.

With reference to FIG. 1, an inner structure of the image forming apparatus will be described. FIG. 1 is a front view schematically showing the inner structure of the image forming apparatus according one embodiment of the present disclosure. In the following description, a front side of a paper surface on which FIG. 1 is drawn is defined as a front side of the image forming apparatus. Fr, Rr, L and R marked in each figure show a front side, a rear side, a left side and a right side of the image forming apparatus respectively.

The image forming apparatus 1 includes an apparatus main body 3 in which a sheet feeding part 5 feeding a sheet S, an image forming part 7 forming a toner image on the fed sheet S, a fixing device 9 fixing the toner image on the sheet S, a discharge device 11 discharging the sheet S and a discharge tray 13 on which the discharged sheet S is stacked are provided. The apparatus main body 3 is provided with a conveyance path 15 along which the sheet S is conveyed from the sheet feeding part 5 to the discharge device 11 through the image forming part 7 and the fixing device 9.

The sheet feeding part 5 includes a sheet feeding cassette part 17 and a manual sheet feeding part 19 as a sheet placement device. The sheet feeding cassette part 17 is provided in the lower portion of the apparatus main body 3. The manual sheet feeding part 19 is provided on one side face (for example, the right side face) of the apparatus main body 3. The sheet feeding cassette part 17 includes a sheet feeding cassette 21 and a sheet feeding unit 23. The sheet feeding cassette 21 in which the sheet S is stored is attachable and detachable to and from the apparatus main body 3. The sheet feeding unit 23 feeds the sheet S from the sheet feeding cassette 21 to the conveyance path 15. The manual sheet feeding part 19 will be described below.

The sheet S fed from the sheet feeding part 5 is conveyed along the conveyance path 15, and the toner image is formed on the sheet S in the image forming part 7. Then, the toner image is fixed on the sheet S by the fixing device 9. The sheet S on which the toner image is fixed is discharged by the discharge device 11 and then stacked on the discharge tray 13.

Figure 2:
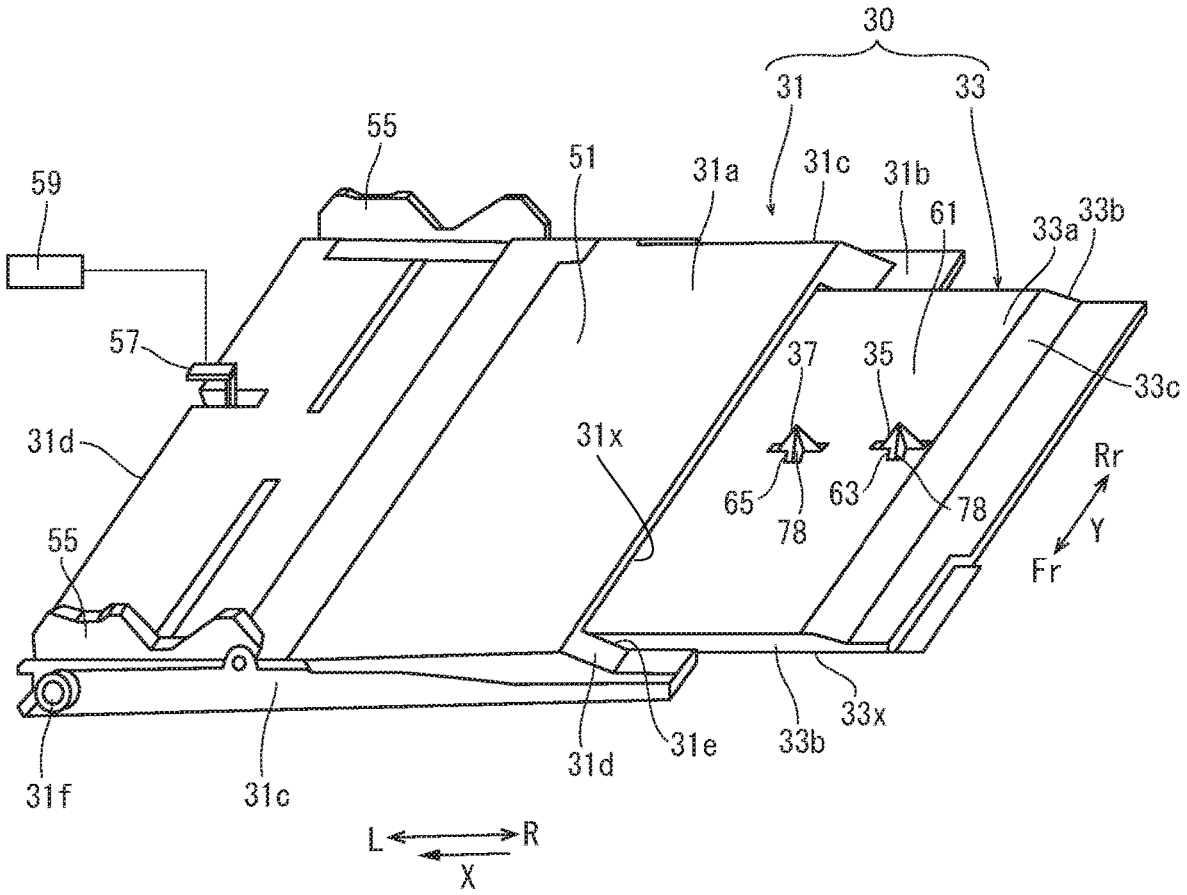
FIG. 2 is a perspective view showing a tray of a sheet loading device according to the embodiment of the present disclosure.
Figure 3:
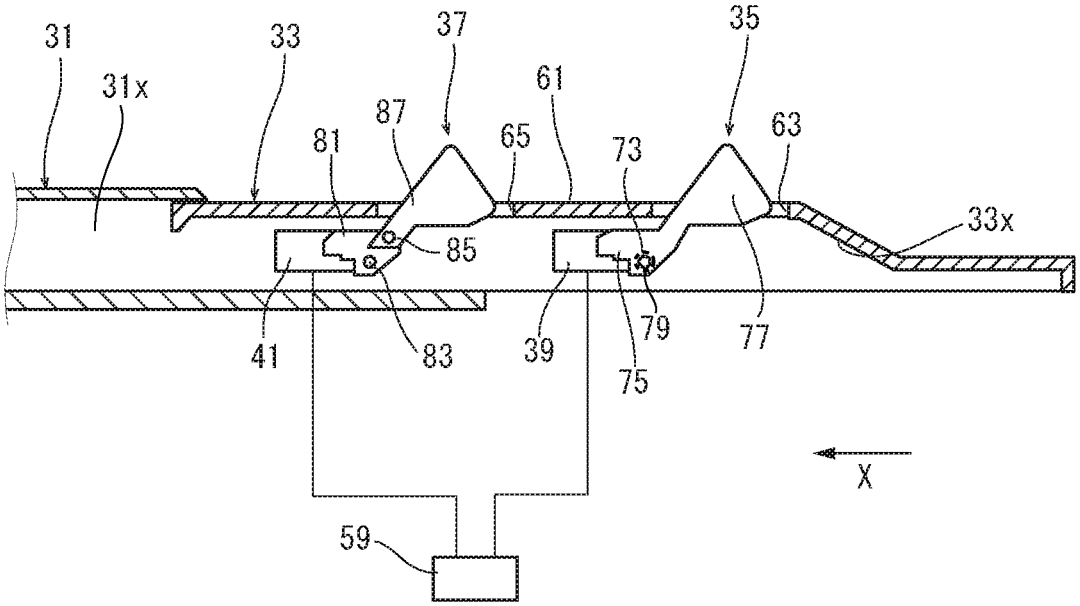
FIG. 3 is a sectional view showing a part of the tray of the sheet loading device according to the embodiment of the present disclosure.
Figure 4:
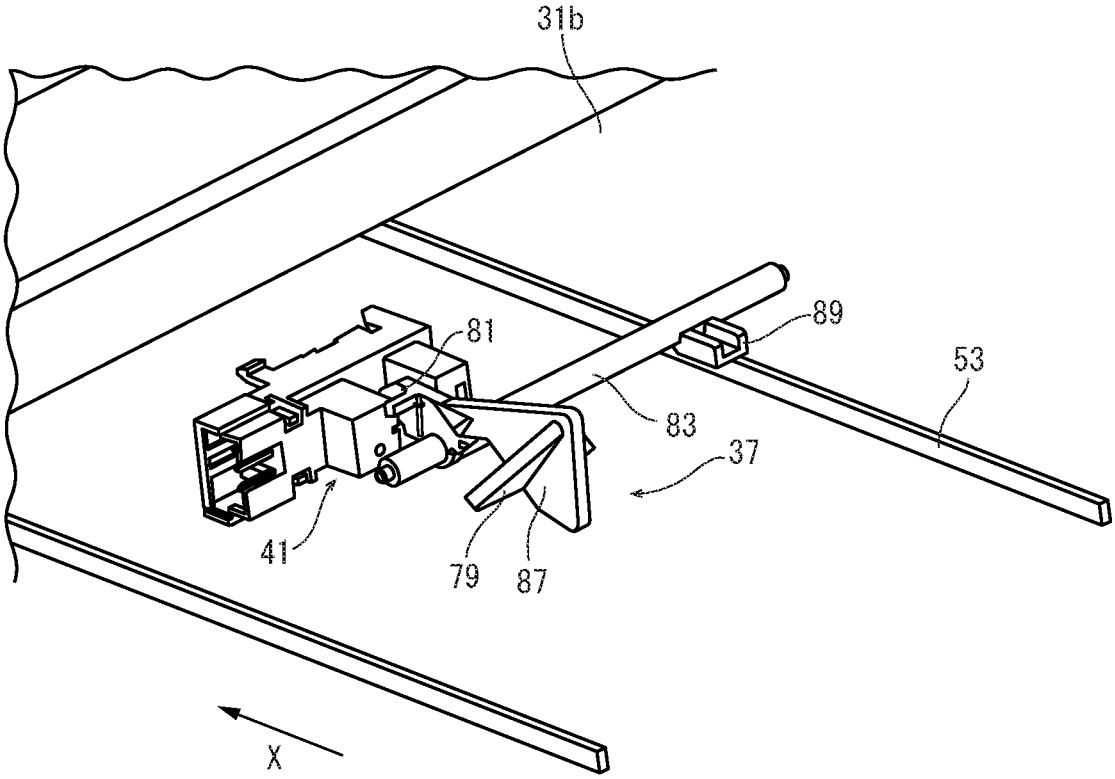
FIG. 4 is a perspective view schematically showing a second detection member and a second detection sensor of the sheet loading device according to the embodiment of the present disclosure.

Next, the manual sheet feeding part 19 will be described with reference to FIG. 2 to FIG. 5, in addition to FIG. 1. FIG. 2 is a perspective view showing the tray, FIG. 3 is a sectional view showing the tray and FIG. 4 is a perspective view showing a second detection member and a second sensor.

As shown in FIG. 1, on the right side face of the apparatus main body 3, a shallow parallelepiped recess 3*a* is formed. In the lower portion of the bottom face of the recess 3*a*, a sheet reception port 3*b* is opened along the front-and-rear direction. On both the side faces of the recess 3*a*, a pair of supporting shafts 3*c* is provided below the sheet reception port 3*b*.

As shown in FIG. 2, the manual sheet feeding part 19 includes a main tray 31, an extension tray 33 supported by the main tray 31, a first detection part 37 and a second detection part 35 which are supported by the extension tray 33. The main tray 31 and the extension tray 33 are an example of a tray 30. The manual sheet feeding part 19 feeds the sheet loaded on the tray 30 (the main tray 31 and the extension tray 33) along a feeding direction X toward the image forming part 7. In the following description, "an upstream side" and "a downstream side" show an upstream side and a downstream side in the feeding direction X respectively.

As shown in FIG. 2, the main tray 31 is a flat parallelepiped hollow member formed by an upper plate 31*a*, a lower plate 31*b*, a pair of side plates 31*c* and a pair of end plates 31*d*. The upper plate 31*a* is divided into an upstream side half plate and a downstream side half plate. On the upper face of the upper plate 31*a*, a sheet loading surface 51 on which a small size sheet (for example, a A5 size and a Statement size) is loaded is formed. As shown in FIG. 4, on the upper face of the lower plate 31*b*, a projection 53 as a restriction part is formed along the feeding direction X at a position displaced from the center in a width direction Y perpendicular to the feeding direction X. With reference to FIG. 2 again, in the upstream end portion of the main tray 31, a hollow storage part 31*x* is formed. In the upstream side end plate 31*d*, an opening 31*e* communicated with the storage part 31*x* is formed along the width direction Y. In the downstream end portions of the pair of side plates 31*c*, a pair of shaft support parts 31*f* is formed.

The main tray 31 is provided with a pair of cursors 55 and a sheet detection part 57. The pair of cursors 55 is supported by the downstream side half plate of the upper plate 31*a* so as to be slidable in the width direction Y so that the sheet loaded on the sheet loading surface 51 is aligned in the width direction Y. The sheet detection part 57 detects whether the sheet is loaded on the sheet loading surface 51. The sheet detection part 57 is electrically connected to the controller 59. The sheet detection part 57 outputs an ON signal to the controller 59 when it detects that the sheet is loaded on the sheet loading surface 51.

As shown in FIG. 1, the pair of the shaft support parts 31*f* of the main tray 31 is supported by the supporting shafts 3*c* of the recess 3*a* of the apparatus main body 3 in a turnable manner. When the manual sheet feeding is not performed, the main tray 31 is turned into a storage posture where it is stored in the recess 3*a*, and when the manual sheet feeding is performed, the main tray 31 is turned into a sheet feeding posture where it protrudes from the recess 3*a* in an oblique upper direction.

As shown in FIG. 2, the extension tray 33 is a member having a size capable of being stored in the storage part 31*x* of the main tray 31, and has a recess 33*x* which is surrounded by an upper plate 33*a*, a pair of side plates 33*b* and an end plate 33*c* and opens to the lower face. On the upper face of the upper plate 33*a*, a sheet loading surface 61 is formed. In the center portion of the sheet loading surface 61 in the width direction Y, a first opening 63 and a second opening 65 are formed side by side along the feeding direction X in the order from the upstream side. The first opening 63 and the second opening 65 are each formed into an approximately cross-shape.

The extension tray 33 is supported by the main tray 31 so as to be displaceable along the feeding direction X between a storage position where it is stored in the storage part 31*x* of the main tray 31 and an extension position (refer to FIG. 2) where it is drawn out from the storage part 31*x* to the upstream side through the opening 31*e*. In the storage position, the sheet is loaded on the sheet loading surface 51 of the main tray 31, and in the extension position, the sheet is loaded on the sheet loading surface 51 of the main tray 31 and the sheet loading surface 61 of the extension tray 33.

The first opening 63 is formed at a position where the first opening 63 is overlapped with a rear end portion (an upstream side end portion) of a large size sheet (a second size, for example, a Forio size and a Legal size) when the large size sheet is loaded on the extension tray displaced into the extension position and is not overlapped with a rear end portion (an upstream end portion) of an intermediate size (a first size, for example, a A4 size and a Letter size) when the intermediate size sheet is loaded on the extension tray 33 displaced into the extension position. The second opening 65 is formed at a position where the second opening 65 is overlapped with the rear end portion (the upstream side end portion) of the intermediate size sheet (the second size, for example, a A4 size and a Letter size) when the intermediate size sheet is loaded on the extension tray 33 displaced into the extension position.

The second detection part 35 will be described with reference to FIG. 3. The second detection part 35 includes a second sensor 39, a second detected piece 75 and a second contact piece 77 formed integrally with the second detected piece 75, and is supported in the recess 33*x* of the extension tray 33.

The second sensor 39 is an optical sensor containing a light emitting part and a light receiving part. The second sensor 39 is disposed on the downstream side of the first opening 63 of the extension tray 33 with the light emitting part and the light receiving part facing each other in the width direction Y. When an optical path is formed between the light emitting part and the light receiving part, the second sensor 39 is switched from an OFF state into an ON state. When the optical path is blocked, the second sensor 39 is switched from the ON state into the OFF state. The second sensor 39 is electrically connected to the controller 59, and outputs an ON signal or an OFF signal to the controller 59.

The second detected piece 75 is formed into an approximately rectangular shape when viewed from a direction crossing the feeding direction X. On the lower portions of both the side faces of the second detected piece 75, second shafts 73 are protruded in the same direction along the width direction Y.

The second detection piece 77 is formed into an approximately triangle shape when viewed from the direction crossing to the feeding direction X. The second detection piece 77 is formed integrally with the upstream upper corner of the second detected piece 75. As shown in FIG. 2, on both the side faces of the second contact piece 77, triangular plate-shaped reinforcement ribs 78 are formed perpendicular to the side faces. Then, the second contact piece 77 is formed into a cross-shape in a plan view.

As shown in FIG. 3, the second detected piece 75 and the second contact piece 77 are disposed on the upstream side of the second sensor 39 with the second detected piece 75 on the downstream side and the second contact piece 77 on the upstream side. Both the end portions of the second shafts 73 are supported by the extension tray 33 in a rotatable manner on the downstream side of the first opening 63 of the extension tray 33.

The second detected piece 75 and the second contact piece 77 are turned together around the second shaft 73 into a protruding posture and a retracting posture. In the protruding posture, the second detected piece 75 extends from the second shaft 73 to the downstream side almost horizontally, and blocks the optical path between the light emitting part and the light receiving part of the second sensor 39 (the position of the second detected piece 75 is called a detectable position). Additionally, the contact piece 77 extends from the second shaft 73 to the upstream side almost horizontally, and protrudes above the sheet loading surface 61 through the first opening 63 (refer to FIG. 3). In this state, the apex portion of the second contact piece 77 is protruded highest above the sheet loading surface 61. In the retracting posture, the second detected piece 75 extends from the second shaft 73 to the downstream side in an oblique upper direction, and is separated away from the optical path between the light emitting part and the light receiving part of the second sensor 39. Additionally, the second contact piece 77 extends from the second shaft 73 to the upstream side in an oblique lower direction, retracts below the sheet loading surface 61 and is stored in the recess 33*x*. Because a cutout is formed at the upstream lower corner of the second contact piece 77, a whole of the second contact piece 77 is stored in the recess 33*x*.

Around the second shaft 73, a torsion coil spring 79 is fitted. The torsion coil spring 79 biases the second detected piece 75 (the second contact piece 77) to turn into the protruding posture (refer to FIG. 3) with respect to the extension tray 33. A biasing force of the torsion coil spring 79 is set to such a degree that when the second contact piece 77 is pushed downward by the sheet loaded on the sheet loading surface 61, the second detected piece 75 (the second contact piece 77) can be turned from the protruding posture into the retracting posture.

Figure 5:
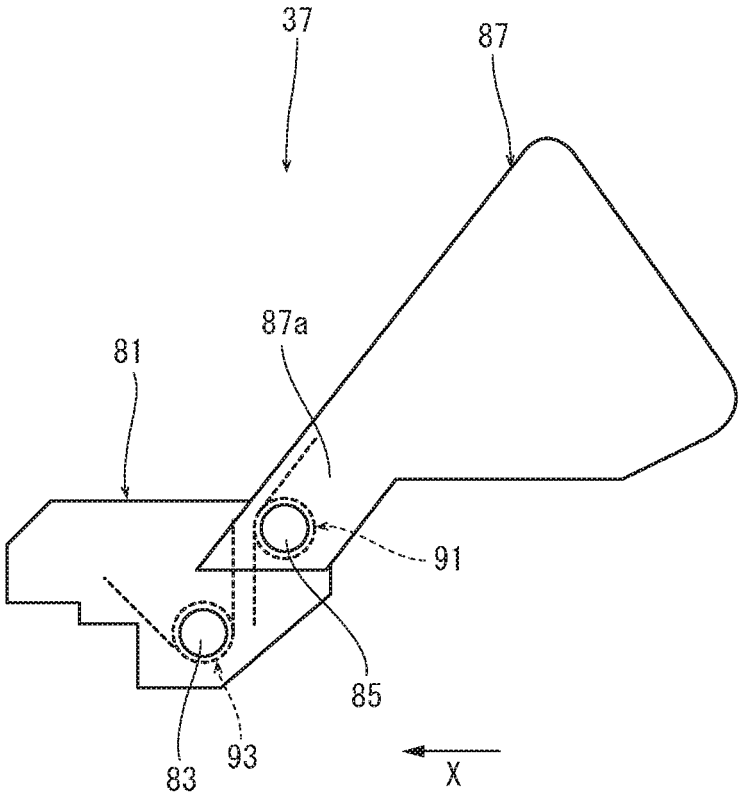
FIG. 5 is a side view schematically showing the second detection member of the sheet loading device according to the embodiment of the present disclosure.

Next, the first detection part 37 will be described with reference to FIG. 5, in addition to FIG. 3 and FIG. 4. FIG. 5 is a side view schematically showing the first detection part 37.

The first detection part 37 include a first sensor 41, a first detected piece 81 and a first contact piece 87, and is supported in the recess 33*x* of the extension tray 33.

The first sensor 41 is an optical sensor containing a light emitting part and a light receiving part. The first sensor 41 is disposed on the downstream side of the second opening 65 of the extension tray 33 with the light emitting part and the light receiving part facing each other in the width direction Y. When an optical path is formed between the light emitting part and the light receiving part, the first sensor 41 is switched from an OFF state into an ON state. When the optical path is blocked, the first sensor 41 is switched from the ON state into the OFF state. The first sensor 41 is electrically connected to the controller 59, and outputs the ON signal or the OFF signal to the controller 59.

As shown in FIG. 5, the first detected piece 81 is formed into an approximately rectangular shape when viewed from the direction crossing to the feeding direction X. On the lower portions of both the side faces of the first detected piece 81, first shafts 83 are protruded in the same direction along the width direction Y. As shown in FIG. 4, on the outer circumferential face of one first shaft 83, a protruding piece 89 is protruded in a direction crossing a rotational direction of the first shaft 83. With reference to FIG. 5 again, at the upstream upper corner on one side face of the first detected piece 81, a coupling shaft 85 is protruded along the width direction Y.

The first contact piece 87 is formed into an approximately triangular shape when viewed from the direction crossing to the feeding direction X. At the downstream lower corner of the first contact piece 87, an extension portion 87*a* extending in an oblique lower direction to the downstream side is formed. The extension portion 87*a* is supported by the coupling shaft 85 of the first detected piece 81 in a turnable manner. As shown in FIG. 2, on both the side faces of the second contact piece 77, triangular plate-shaped reinforcement ribs 78 are formed perpendicular to the side faces. Then, the second contact piece 77 is formed into a cross-shape in a plan view.

Around the coupling shaft 85, a first torsion coil spring 91 as a first biasing member is fitted. The first torsion coil spring 91 biases the first contact piece 87 into a predetermined posture with respect to the first detected piece 81. The predetermined posture shows the same posture as the second detected piece 75 and the second contact piece 77 of the second detection part 35. In detail, the first detected piece 81 and the first contact piece 87 extend in opposite directions with respect to the coupling shaft 85.

As shown in FIG. 3, the first detected piece 81 and the first contact piece 87 are disposed on the upstream side of the first sensor 41 with the first detected piece 81 on the downstream side and the first contact piece 87 on the upstream side. Both the end portions of the first shafts 83 are supported by the extension tray 33 in a rotatable manner on the downstream side of the second opening 65 of the extension tray 33. In this state, the protruding piece 89 of the first shaft 83 is aligned with the projection 53 of the lower plate 31*b* of the main tray 31 along the feeding direction X (the protruding piece 89 and the projection 53 are disposed at the same position in the width direction Y, refer to FIG. 4).

The first detected piece 81 and the first contact piece 87 are turned together with the first shaft 83 around the first shaft 83 into a protruding posture and a retracting posture. In the protruding posture, the first detected piece 81 extends from the first shaft 83 to the downstream side almost horizontally, blocks the optical path between the light emitting part and the light receiving part of the first sensor 41 (the position of the first detected piece 81 is called a detectable position). Additionally, the first contact piece 87 extends from the first shaft 83 to the upstream side almost horizontally, and protrudes above the sheet loading surface 61 through the second opening 65 (refer to FIG. 3). In this state, the apex portion of the first contact piece 87 is protruded highest above the sheet loading surface 61. In the retracting posture, the first detected piece 81 extends from the first shaft 83 to the downstream side in an oblique upper direction, and is separated away from the optical path between the light emitting part and the light receiving part of the first sensor 41. Additionally, the first contact piece 87 extends from the first shaft 83 to the upstream side in an oblique lower direction, retracts below the sheet loading surface 61 and is stored in the recess 33*x*. Because a cutout is formed at the upstream lower corner of the first contact piece 87, a whole of the first contact piece 87 is stored in the recess 33*x*.

Around the first shaft 83, a second torsion coil spring 93 is fitted. The second torsion coil spring 93 biases the first detected piece 81 (the first contact piece 87) to turn into the protruding posture (refer to FIG. 3) with respect to the extension tray 33. A biasing force of the second torsion coil spring 93 is smaller than the biasing force of the first torsion coil spring 91 and the same as the biasing force of the torsion coil spring 79 of the second detection part 35.

Figure 6A:
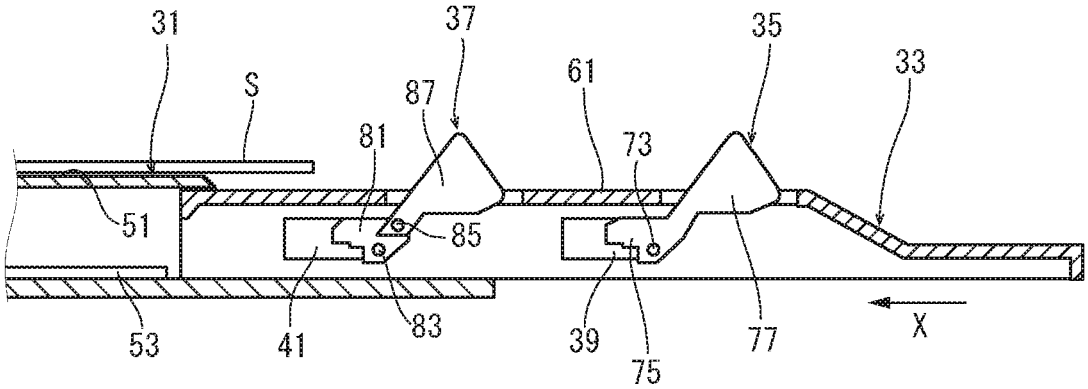
FIG. 6A is a side view showing a first detection member and the second detection member in a state where a small size sheet is loaded, in the sheet loading device according to the embodiment of the present disclosure.
Figure 6B:
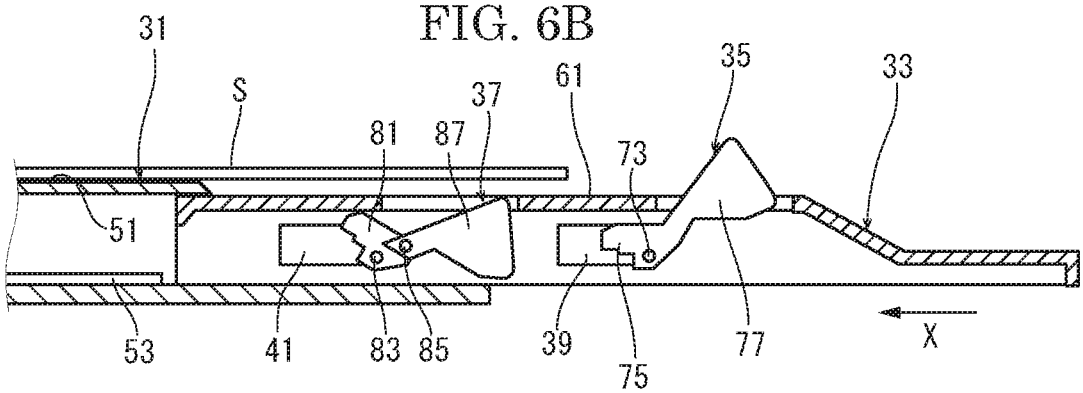
FIG. 6B is a side view showing the first detection member and the second detection member in a state where an intermediate size sheet is loaded, in the sheet loading device according to the embodiment of the present disclosure.
Figure 6C:
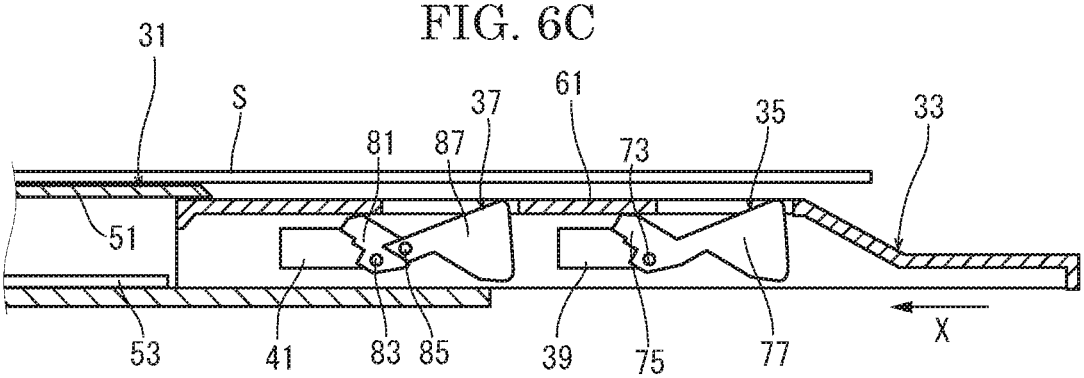
FIG. 6C is a side view showing the first detection member and the second detection member in a state where a large size sheet is loaded, in the sheet loading device according to the embodiment of the present disclosure.

In the manual sheet feeding part 19 having the above described configuration, a sheet size detection operation will be described with reference to FIG. 6A to FIG. 6D and FIG. 7, in addition to FIG. 3. FIG. 6A to FIG. 6D are sectional views showing the extension tray, and FIG. 7 is a table showing a determination result. FIG. 6A to FIG. 6C shows the sheet S floated above the first contact piece 87 of the first detection part 37 and the second contact piece 77 of the second detection part 35, but in actually, the sheet S comes into contact with the first contact piece 87 of the first detection part 37 and the second contact piece 77 of the second detection part 35.

Firstly, with reference to FIG. 3, the first detection part 37 and the second detection part 35 in a state where the extension tray 33 is displaced into the extension position will be described. In the second detection part 35, the second detected piece 75 and the second contact piece 77 are turned into the protruding position. That is, the second detected piece 75 blocks the optical path of the second sensor 39, and the second contact piece 77 protrudes above the sheet loading surface 61 through the first opening 63. The second sensor 39 output the OFF signal to the controller 59.

In the first detection part 37, the first detected piece 81 and the first contact piece 87 are turned into the protruding position. That is, the first detected piece 81 blocks the optical path of the first sensor 41, and the first contact piece 87 protrudes above the sheet loading surface 61 through the second opening 65. The first sensor 41 output the OFF signal to the controller 59.

In the above manner, in the state where the extension tray 33 is displaced into the extension position, both the first and the second sensors 41 and 49 output the OFF signal to the controller 59.

Next, with reference to FIG. 6A, a case where a small size sheet S (for example, a A5 size and a Statement size) is loaded will be described. When the small size sheet S is loaded on the sheet loading surface 51 of the main tray 31, the sheet detection part 57 (refer to FIG. 2) outputs the ON signal to the controller 59. The small size sheet S is mainly loaded on the sheet loading surface 51 of the main body 31 and is not loaded on the sheet loading surface 61 of the extension tray 33. Thus, the sheet S is not overlapped with the first detection part 37 and the second detection part 35, and then the first sensor 41 and the second sensor 39 output the OFF signal to the controller 59. When the ON signal is input from the sheet detection part 57 and the OFF signal is input from the first and second sensors 41 and 39, the controller 59 determines that the small size sheet is loaded (refer to FIG. 7).

Next, with reference to FIG. 6B, a case where an intermediate size sheet (a first size, for example, a A4 size and a Letter size) is loaded on the main tray 31 will be described with reference to FIG. 6B. When the intermediate size sheet S is loaded on the loading surface 51 of the main tray 31, the sheet detection part 57 outputs the ON signal to the controller 59. The intermediate size sheet S is loaded on the sheet loading surface 51 of the main tray 31 and the downstream side portion of the sheet loading surface 61 of the extension tray 33. That is, the rear portion (the upstream end portion) of the intermediate size sheet S is overlapped with the first detection part 37. Thus, the first contact piece 87 of the first detection part 37 is pushed downward by the sheet S.

Then, the first contact piece 87 and the first detected piece 81 are turned around the first shaft 83 from the protruding posture into the retracting posture against the biasing force of the second torsion coil spring 93 while being kept in the predetermined posture. That is, the biasing force of the first torsion coil spring 91 is larger than the biasing force of the second torsion coil spring 93, so that when the first contact piece 87 is pushed downward, the first torsion coil spring 91 is not elastically deformed while the second torsion coil spring 93 is elastically deformed preferentially. Thus, the first contact piece 87 and the first detected piece 81 are turned together from the protruding posture into the retracting posture around the first shaft 83 while being kept in the predetermined posture.

As a result, the first detected piece 81 is separated away from the optical path of the first sensor 41, and the first sensor 41 outputs the ON signal to the controller 59. When the ON signal is input from the sheet detection part 57, the ON signal is input from the first sensor 41 and the OFF signal is input from the second sensor 39, the controller 59 determines that the intermediate size sheet S is loaded (refer to FIG. 7).

Next, with reference to FIG. 6C, a case where a large size sheet S (a second size, for example, a Folio size and a Regal size) is loaded will be described. When the large size sheet S is loaded on the sheet loading surface 51 of the main tray 31, the sheet detection part 57 outputs the ON signal to the controller 59. The large size sheet S is loaded on the sheet loading surface 51 of the main tray 31 and almost the whole of the sheet loading surface 61 of the extension tray 33. That is, the rear portion (the upstream end portion) of the large size sheet S is overlapped with the first detection part 37 and the second detection part 35. Thus, in the first detection part 37, the first contact piece 87 and the first detected piece 81 are turned together from the protruding posture into the retracting posture, in the same manner as the case of the intermediate size sheet. The first detected piece 81 is separated away from the optical path of the first sensor 41, and the first sensor 41 outputs the ON signal to the controller 59.

Additionally, in the second detection part 35, the second contact piece 77 is pushed downward by the sheet S, the second contact piece 77 and the second detected piece 75 are turned together from the protruding posture into the retracting posture, and the second detected piece 75 is separated away from the optical path of the second sensor 39. Then, the second sensor 39 outputs the ON signal to the controller 59. When the ON signal is input from the sheet detection part 57 and the ON signal is input from both the first sensor 41 and the second sensor 39, the controller 59 determines that the large size sheet S is loaded (refer to FIG. 7).

Figure 6D:
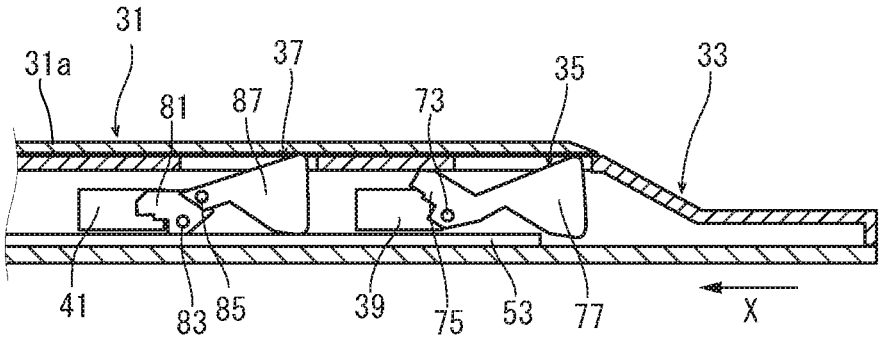
FIG. 6D is a side view showing the first detection member and the second detection member in a state where an extension tray is displaced into a storage position, in the sheet loading device according to the embodiment of the present disclosure.

Next, with reference to FIG. 6D, a case where the extension tray 33 is displaced from the extension position into the storage position will be described. When the extension tray 33 is displaced from the extension position into the storage position, the first contact piece 87 of the first detection part 37 and the second contact piece 77 of the second detection part 35 are pushed downward by the upper wall (the upper plate 31*a*) of the storage part 31*x* of the main tray 31. Furthermore, the protruding piece 89 of the first shaft 83 of the first detection part 37 is aligned with the projection 53 of the lower plate 31*b* of the main tray 31 in the width direction Y.

When the second contact piece 77 of the second detection part 35 is pushed downward by the sheet, the second contact piece 77 and the second detected piece 75 are turned together from the protruding posture into the retracting posture, the second detected piece 75 is separated away from the optical path of the second sensor 39, and then the second sensor 39 outputs the ON signal. On the other hand, the first contact piece 87 and the first detected piece 81 of the first detection part 37 also try to be turned from the protruding posture into the retracting posture. In detail, the first shaft 83 of the first detected piece 81 tries to be rotated in the clockwise direction in FIG. 6D. However, as shown in FIG. 4, the protruding piece 89 of the first shaft 83 comes into contact with the projection 53 of the main tray 31, and the rotation of the first shaft 83, that is, the turning of the first detected piece 81 is inhibited. Then, the first contact piece 87 is turned around the coupling shaft 85 in the clockwise direction in FIG. 6D with respect to the first detected piece 81 against the biasing force of the first torsion coil spring 91. In the above manner, the first detected piece 81 is kept blocking the optical path of the first sensor 41, and the first sensor 41 outputs the OFF signal to the controller 59. Because the sheet is not loaded on the tray 30, the sheet detection part 57 outputs the OFF signal to the controller 59. When the OFF signal is input from the sheet detection part 57, the OFF signal is input from the first sensor 41 and the ON signal is input from the second sensor 39, the controller 59 determines that the extension tray 33 is displaced into the storage position (refer to FIG. 7)

In a case where the extension tray 33 is displaced into the storage position and the small size sheet is loaded on the sheet loading surface 51 of the main tray 31, the sheet detection part 57 outputs the ON signal to the controller 59. When the ON signal is input from the sheet detection part 57, the OFF signal is input from the first sensor 41 and the ON signal is input from the second sensor 39, the controller 59 determines that the small size sheet is loaded on the main tray 31.

As described above, according to the manual sheet feeding part 19 of the present disclosure, it becomes possible to determine the size (the small size, the intermediate size and the large size) of the sheet loaded on the tray 30 and the position of the extension tray 33 using two sensors (the first sensor 41 and the second sensor 39). Accordingly, it becomes possible to suppress the increasing of the number of the sensor and to make the configuration and the control simple.

Especially, by making the output state of the first sensor 41 different from the output state of the second sensor 39 between the case where the large size sheet is loaded and the case where the extension tray 33 is displaced into the storage position, it becomes possible to discriminate the case where the large size sheet is loaded on the tray 30 from the case where the extension tray 33 is displaced into the storage position.

In the present embodiment, the protruding piece 89 is formed in the first shaft 83, so that a sufficient large space can be used effectively. The protruding piece 89 may be formed in the first detected piece 81.

The present embodiment describes a case where the present disclosure is applied for the manual sheet feeding part 19 of the image forming apparatus. However, the present disclosure may be applied for a document feeding part of a document conveyance apparatus.

The present disclosure has been described with respect to specific embodiments, the present disclosure is not limited to the above embodiments. The above embodiment can be modified by those skilled in the art without departing from the scope and sprit of the present disclosure.

The invention claimed is:

1. A sheet loading device comprising a tray having a sheet loading surface on which a sheet fed in a predetermined feeding direction is loaded, wherein the tray includes:

a main tray having a storage part on an upstream side in the feeding direction;

an extension tray displaceable between a storage position where the extension tray is stored in the storage part and an extension position where the extension tray extends from the storage part to the upstream side in the feeding direction; and a first detection part provided in the extension tray and detecting a first size sheet, the first detection part includes;

a first sensor;

a first detected piece turnably supported by the extension tray to switch the first sensor between an ON state and an OFF state, and a first contact piece turnably supported by the first detected piece, and protruding above and retracting below the sheet loading surface, wherein in a state where the extension tray is arranged in the extension position, when the first size sheet is not loaded on the extension tray, the first contact piece is turned so as to protrude above the sheet loading surface and the first detected piece is turned so as to switch the first sensor from the ON state into the OFF state, and when the first size sheet is loaded on the extension tray, the first contact piece is turned so as to be retracted below the sheet loading surface by coming into contact with the first size sheet, and the first detected piece is turned so as to switch the first sensor from the OFF state into the ON state, and in a state where the extension tray is arranged in the storage position, the first contact piece comes into contact with an upper wall of the storage part and is turned so as to retract below the sheet loading surface, and the first detected piece interferes with a restriction part provided in the storage part and is inhibited from being turned so as to switch the first sensor from the OFF state into the ON state.

2. The sheet loading device according to claim 1, comprising:

a second detection part provided in the extension tray on the upstream side of the first detection part in the feeding direction and detecting a second size sheet longer than the first size sheet in the state where the extension tray is arranged in the extension position; and a controller for determining a size of the sheet loaded on the sheet loading surface and a position of the extension tray, based on detection results of the first detection part and the second detection part, wherein the second detection part includes:

a second sensor;

a second detected piece turnably supported by the extension tray and switching the second sensor between an ON state and an OFF state; and a second contact piece formed integrally with the second detected piece, and protruding above and retracting below the sheet loading surface, wherein in a case where the first sensor is switched into the ON state and the second sensor is switched into the OFF state, the controller determines that the first size sheet is loaded on the sheet loading surface, in a case where the first sensor is switched into the ON state and the second sensor is switched into the ON state, the controller determines that the second size sheet is loaded on the sheet loading surface, and in a case where the first sensor is switched into the OFF state and the second sensor is switched into the ON state, the controller determines that the extension tray is arranged in the storage position.

3. The sheet placement device according to claim 1, wherein the first detected piece includes:

a first shaft rotatably supported by the extension tray; and a coupling shaft supporting the first contact piece turnably, wherein in the state where the extension tray is arranged in the extension position, the first detected piece and the first contact piece are turned together around the first shaft, and while the extension tray is moved from the extension position to the storage position and is arranged in the storage position, the first shaft interferes with the restriction part to restrict rotating, whereby the first detected piece is prevented turned turning, and the first contact piece comes into contact with the upper wall of the storage part and is turned around the coupling shaft with respect to the first detected piece.

4. The sheet loading device according to claim 3, wherein the first detection part includes:

a first biasing member fitted around the coupling shaft and biasing the first contact piece at a predetermined angle with respect to the first detected piece; and a second biasing member having a biasing force smaller than a biasing force of the first biasing member, fitted around the first shaft, and biasing the first detected piece to a detectable position where the first sensor is switched from the OFF state into the ON state, wherein when the first size sheet is not loaded on the extension tray, the first detected piece is biased by the second biasing member so as to turn to the detectable position, and the first contact piece is biased by the first biasing member so as to protrude above the sheet loading surface, when the first size sheet is loaded on the extension tray, the first contact piece is turned so as to be retracted below the sheet loading surface in a state where a positional relationship with the first detected piece is maintained by the first biasing member, so that the first detected piece is turned in a direction separate away from the detectable position against the biasing force of the second biasing member, and when the extension tray is arranged in the storage position, the first detected piece interferes with the restriction part and is inhibited from being turned in the direction separate away from the detectable position, and the first contact piece is turned with respect to the first detected piece against the biasing force of the first biasing member so as to be retracted below the sheet loading surface.

5. The sheet loading device according to claim 4, wherein the restriction part is a projection which comes into contact with the first detected piece and inhibits a turning of the first detected piece while the first detected piece is turned in the direction separate away from the detectable position, and when the extension tray is arranged in the storage position, the first detected piece comes into contact with the projection and is inhibited from being turned in the direction separate away from the detectable position.

6. The sheet loading device according to claim 3, wherein the first detected piece has a protruding piece protruding from the coupling shaft in a radial direction, and while the first detected piece is turned in the direction separate away from the detectable position, the protruding piece comes into contact with the restriction part to inhibit a turning of the first detected piece.

7. The sheet loading device according to claim 3, wherein the extension tray has an upper plate, a pair of side plates, an end plate and a recess surrounded by the upper plate, the pair of side plates and the end plate, the recess is opened to a lower face, and the first detection part and the second detection part are provided in the recess.

8. The sheet loading device according to claim 2, comprising a sheet detection part which is provided in the main tray and switched into an ON state where a sheet is loaded on the sheet loading surface and into an OFF state where a sheet is not loaded on the sheet loading surface, wherein when the sheet detection part is in the ON state, the first sensor is in the OFF state and the second sensor is in the OFF state, the controller determines that a small size sheet is loaded on the sheet loading surface, when the sheet detection part is in the ON state, the first sensor is in the ON state and the second sensor is in the OFF state, the controller determines that an intermediate size sheet is loaded on the sheet loading surface, when the sheet detection part is in the ON state, the first sensor is in the ON state and the second sensor is in the ON state, the controller determines that the large size sheet is loaded on the sheet loading surface, and when the sheet detection part is in the OFF state, the first sensor is in the OFF state and the second sensor is in the ON state, the controller determines that the extension tray is arranged in the storage position.

9. An image forming apparatus comprising:

the sheet loading device according to claim 1, and an image forming part which forms an image on a sheet fed from the sheet loading device.

* * * * *